US009126305B2

(12) United States Patent
Champaigne et al.

(10) Patent No.: US 9,126,305 B2
(45) Date of Patent: Sep. 8, 2015

(54) SHOT PEENING FLOW RATE CONTROL

(71) Applicants: Jack Champaigne, Mishawaka, IN (US); Mark Ingram, Granger, IN (US)

(72) Inventors: Jack Champaigne, Mishawaka, IN (US); Mark Ingram, Granger, IN (US)

(73) Assignee: Electronics, Inc., Mishawaka, IN (US)

( * ) Notice: Subject to any disclaimer, the term of this patent is extended or adjusted under 35 U.S.C. 154(b) by 189 days.

(21) Appl. No.: 13/759,132

(22) Filed: Feb. 5, 2013

(65) Prior Publication Data

US 2014/0220861 A1 Aug. 7, 2014

(51) Int. Cl.
*B24C 7/00* (2006.01)

(52) U.S. Cl.
CPC ..... *B24C 7/00* (2013.01)

(58) Field of Classification Search
None
See application file for complete search history.

(56) References Cited

U.S. PATENT DOCUMENTS

| | | | | |
|---|---|---|---|---|
| 4,354,622 | A | 10/1982 | Wood | |
| 4,402,344 | A * | 9/1983 | Kemmner | 137/625.33 |
| 4,625,565 | A * | 12/1986 | Wada et al. | 73/861.74 |
| 4,873,855 | A * | 10/1989 | Thompson | 72/53 |
| 6,199,587 | B1 * | 3/2001 | Shlomi et al. | 137/625.5 |
| 7,044,111 | B2 * | 5/2006 | Cook | 123/520 |
| 8,388,407 | B1 * | 3/2013 | Champaigne | 451/2 |
| 2008/0006791 | A1 * | 1/2008 | Reinicke | 251/65 |

* cited by examiner

*Primary Examiner* — Joseph J Hail
*Assistant Examiner* — Brian Keller
(74) *Attorney, Agent, or Firm* — Botkin & Hall, LLP

(57) ABSTRACT

A shot peening flow rate control that is useful for non-ferrous shot peening media. The control has an inlet for receiving media and an orifice through which the media may pass that is in communication with the inlet. A valve selectively blocks the orifice. The valve has a spindle that is guided for axial movement between an open and closed position. The closed position blocks the orifice and the open position places the spindle spaced from the orifice to allow media to flow through the orifice. A flow sensor has a deflectable member that extends into a flow path of media leaving the orifice. In response to increasing or decreasing flow of the media through the flow path the deflectable member will deflect more or less. A sensing device measures the deflection in the deflectable member and generates an electrical signal that varies in response to deflection in the deflectable member.

20 Claims, 8 Drawing Sheets

SHOT PEENING FLOW RATE CONTROL

BACKGROUND OF THE INVENTION

Treatment of a work piece by shot peening with granular media is an important finishing step in an increasing number of products as the benefits of doing so are becoming more well known. Controlling the peening flow rate for dispensing the peening media is important to provide predictable and repeatable results. In prior art peening systems, the flow rate of the media has been set with a fixed orifice sometimes with a mechanical or electrical valve. However, feedback to the controlling valve has not typically been provided by sensing the actual flow rate of media dispensed through the valve.

Often times the media used in peening is some type of ferrous metal. Spherically conditioned cut wire (SCCW) is often used due to its low cost and the wire is a steel product. Controlling ferrous metals can be done with a magnetic valve that when magnetized slows the fall of the metallic media through the valve. Sometimes, it is desirable to use non-metallic media such as glass beads or other ceramic material. In this case, a magnetic valve will serve no purpose in metering flow. Ideally a valve for non-ferrous media should be able to control the flow rate based on measuring the flow rate dispensed by a valve and then actuating the valve to achieve the desired flow rate.

SUMMARY OF THE INVENTION

The present invention is a shot peening flow rate control that has an inlet for receiving media and an orifice through which the media may pass that is in communication with the inlet. A valve selectively blocks the orifice. The valve has a spindle that is guided for axial movement between an open and closed position. The closed position blocks the orifice, and in the open position the spindle is away from the orifice to allow media to flow through the orifice. The media leaving the orifice defines a flow path. A flow sensor has a deflectable member that extends into the flow path. In response to increasing or decreasing the flow of the media through the flow path, the deflectable member will deflect more or less. A sensing device measures the deflection in the deflectable member and generates an electrical signal that varies in response to deflection in the deflectable member.

DETAILED DESCRIPTION OF INVENTION

Figure 1:
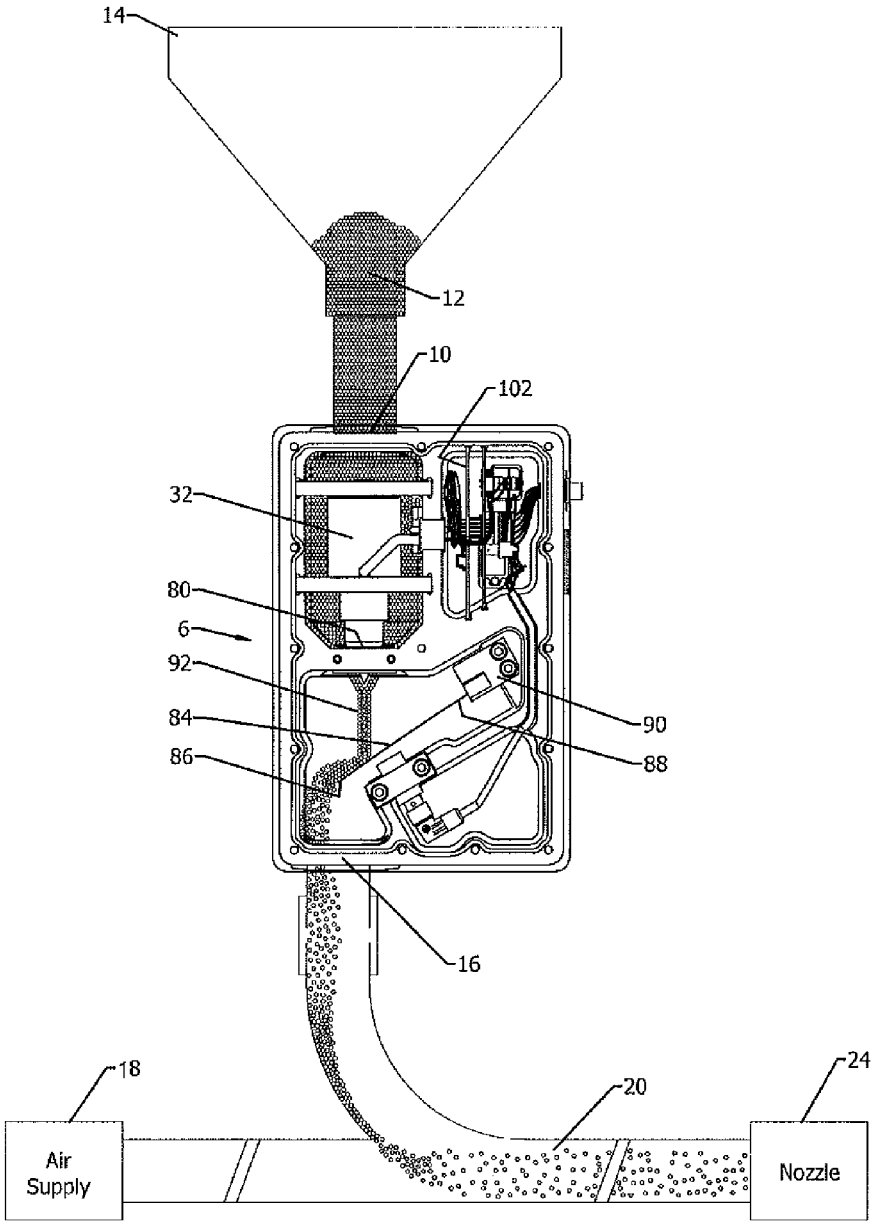
FIG. 1 is an overview of the shot peening control in a shot peening system.
Figure 2:
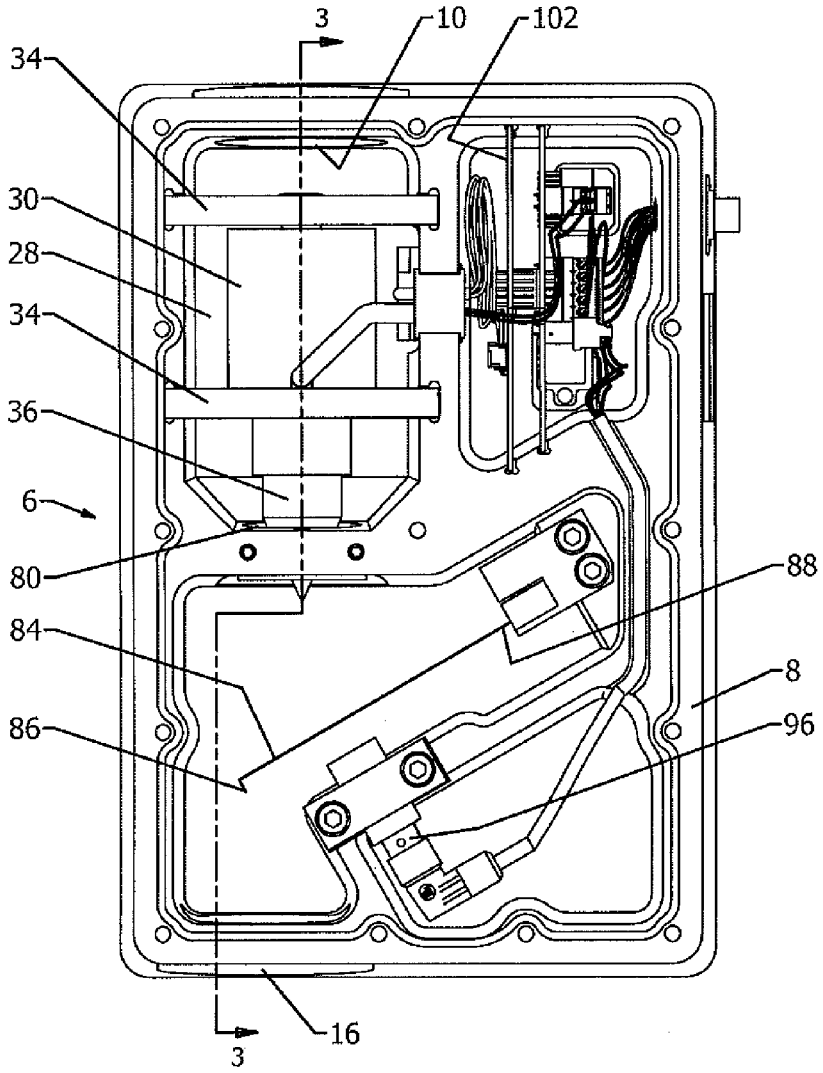
FIG. 2 is a view of the housing of the shot peening control open to show the internal parts.
Figure 3:
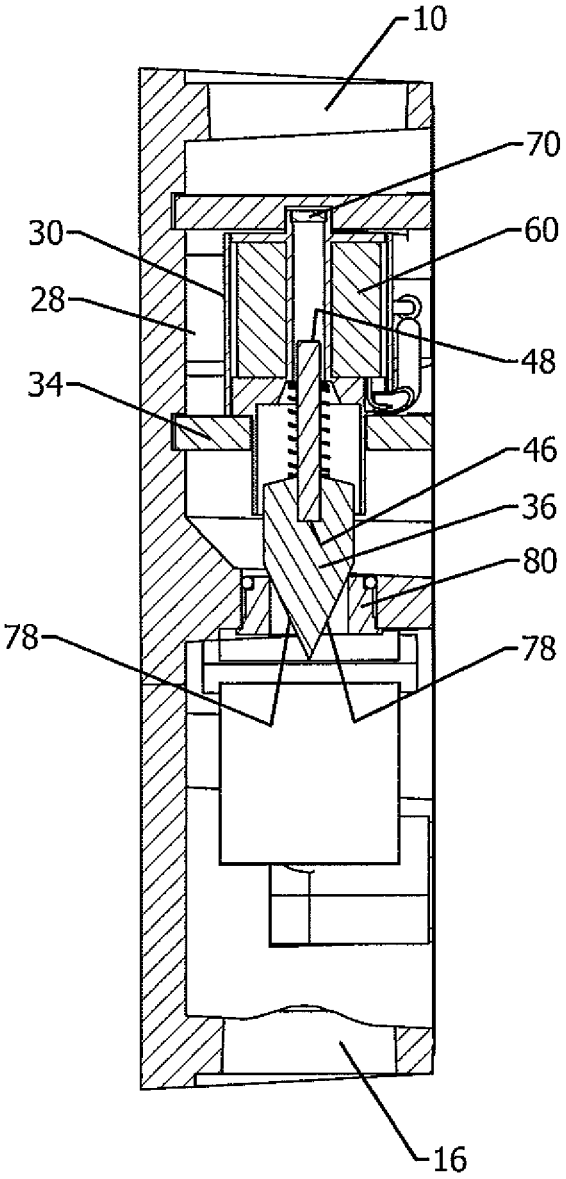
FIG. 3 is a sectional view taken about the line 3-3 in FIG. 2.
Figure 4:
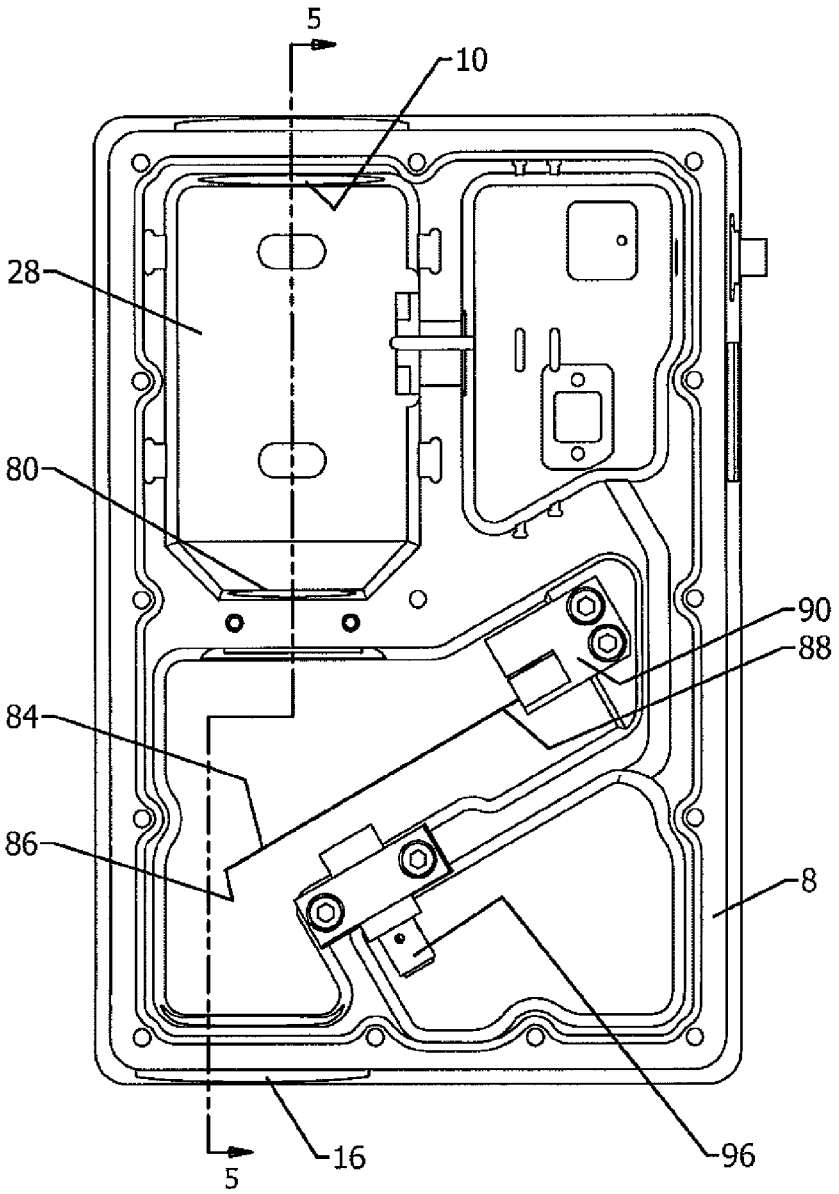
FIG. 4 is a view of the housing of the shot peening control open to show the internal parts with the valve removed.
Figure 5:
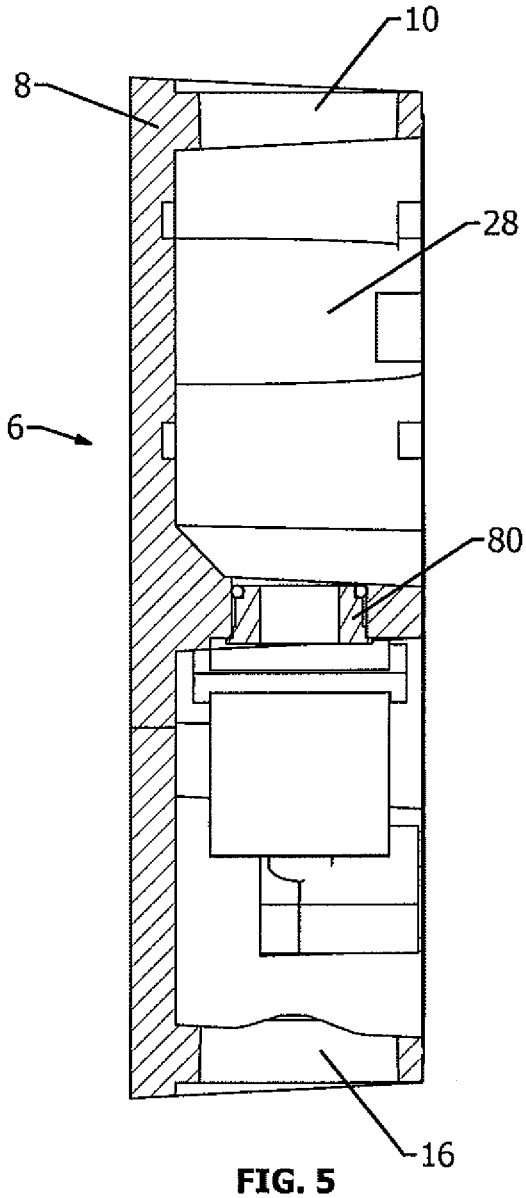
FIG. 5 is a sectional view taken about the line 5-5 in FIG. 4.
Figure 6:
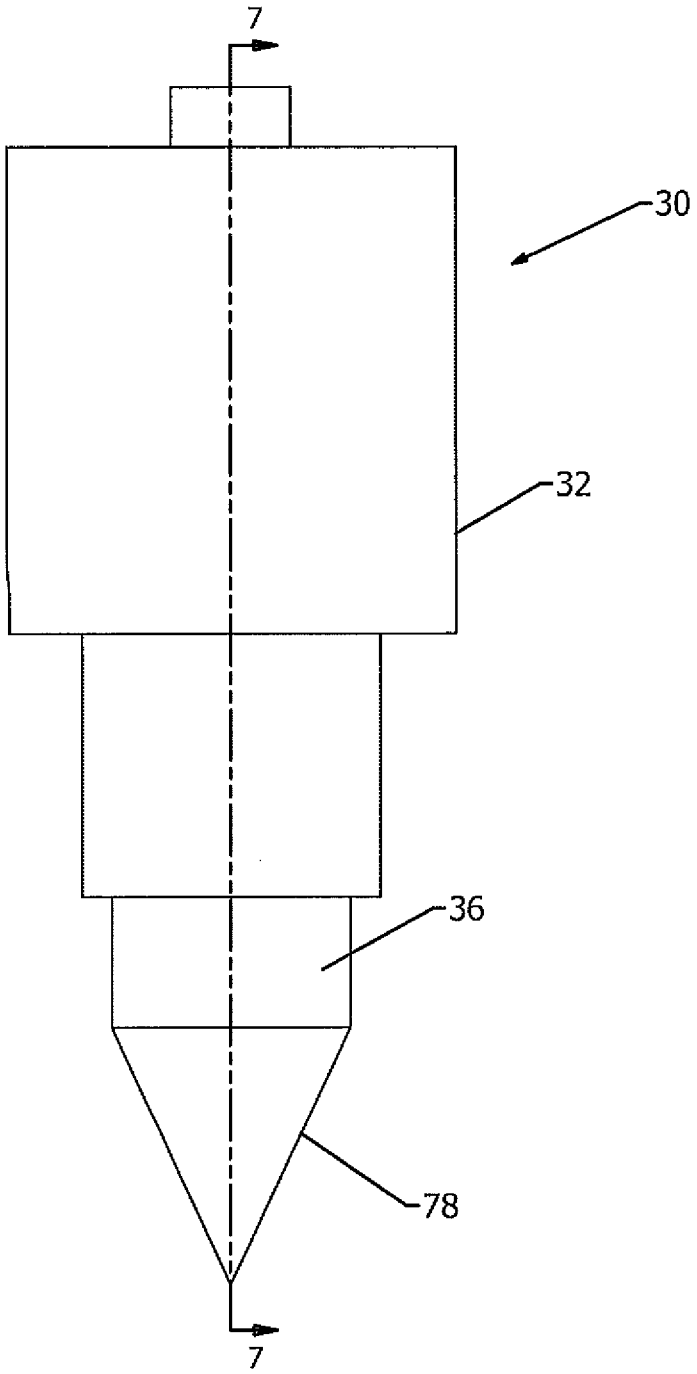
FIG. 6 is a view of the valve taken out of the housing.

FIG. 1 shows an overview of the shot peening flow rate control 6 of the present invention as it is incorporated in a shot peening system. As is typically done in shot peening, media 12 is held in a hopper 14 that feeds the shot peening system. The media 12 flows into an inlet 10 of the control 6 and out of an outlet 16 of the control 6. Once a properly metered amount of media 12 having a desired flow rate leaves the outlet 16, it is mixed with air from an air supply 18 that is directed into a mixing tube 20 and leaves through a nozzle 24 that directs the media onto a work piece. Controlling the flow rate of air out of the air supply 18 is relatively simple and well known in the art of peening. Controlling the rate of media 12 leaving the control 6 is necessary to have a predictable mixture of air and media 12 that will be used to peen the part. The more predictable the air/media mixture is, the more predictable the peening results will be.

Controlling ferrous media may be done by taking advantage of its magnetic properties. However, when non-ferrous media such as glass or ceramic is used controlling the media 12 is more difficult. The control 6 of the present invention is adapted to handle non-ferrous media 12. The control 6 of the present invention has a housing 8 with its inlet 10 connected downstream of the hopper 14. Immediately downstream of the inlet 10 is a valve chamber 28 that holds a valve 30. The valve 30 has a valve body 32 that is held with straps 34 in the valve chamber 28. Media 12 can flow around all sides of the valve 30 as it passes through the valve chamber 28.

Figure 7:
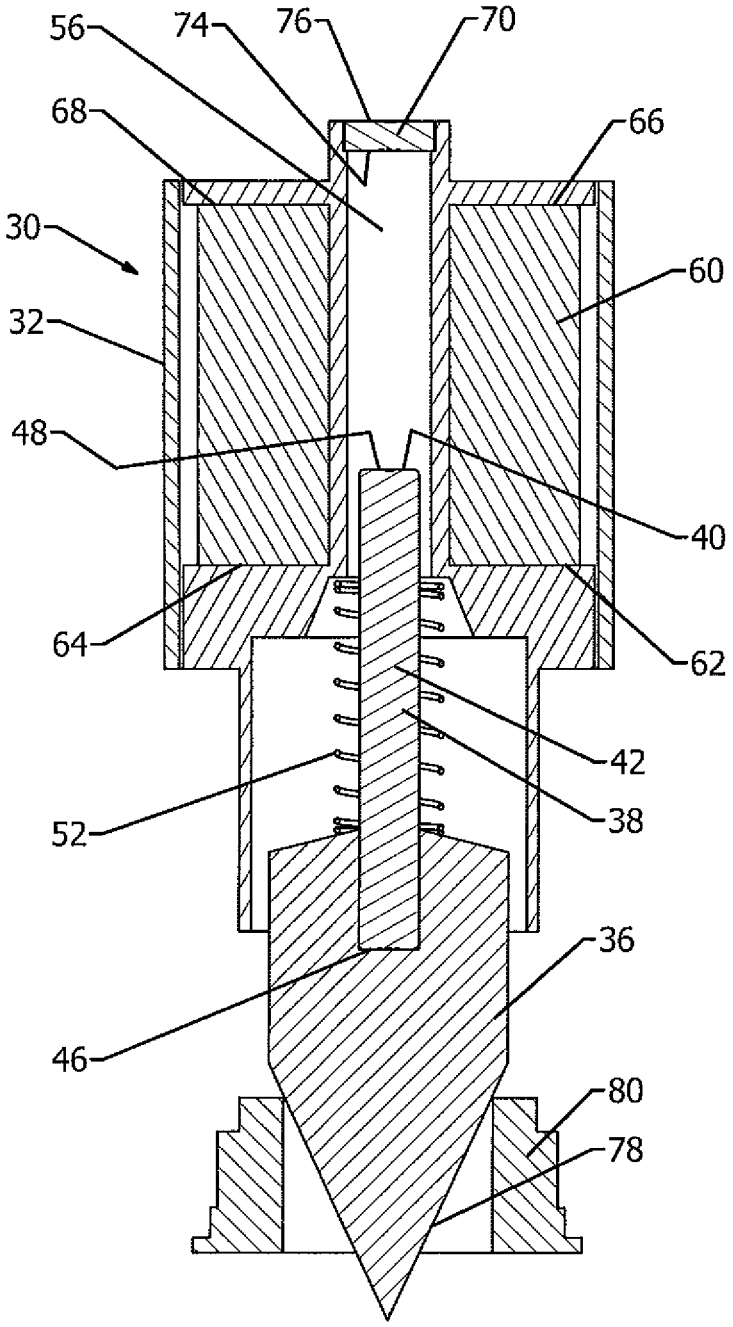
FIG. 7 is a sectional view of the valve taken about line 7-7 in FIG. 6.

The valve 30 includes a spindle 36 that has a rod 38 extending upwardly therefrom as shown in FIG. 7. The rod 38 has a distal end 40 that is opposite the spindle 36. The rod 38 is magnetized and forms a first permanent magnet 42. The first permanent magnet 42 has a first pole 46 that is within the spindle 36. In FIG. 7, the first pole 46 is the north magnetic pole. The second pole 48 of the first permanent magnet 42 is upwardly facing in FIG. 7 and is the south magnetic pole. A spring 52 is placed around the rod 38 and pushes down on the spindle 36. The rod 38 and spindle 36 are guided for axial movement with respect to the valve body 32. The rod 38 extends upwardly into bore 56 that extends upwardly into an electromagnet coil 60. The coil 60 has magnetic poles when electricity is passed through the coil 60. At a first end 62 the coil 60 has a first pole 64; the first pole 64 is a south magnetic pole. At a second end 66 the coil 60 has a second pole 68. The second pole 68 is a north magnetic pole. At the end of the bore 56 is a second permanent magnet 70. The second permanent magnet 70 is fixed with respect to the coil 60 and has a first pole 74 and a second pole 76. The first pole 74 of the second permanent magnet 70 is a north magnetic pole and faces toward the first permanent magnet 42. The spindle 36 has a conical surface 78 that is adapted for sealing against orifice 80. The valve 30 will work if opposite poles of the first and second permanent magnets 42, 70 face each other and the second pole 68 at the upper end of the coil 60 is opposite the second pole 48 of the first permanent magnet 42.

The orifice 80 is located directly above a beam 84 that is a cantilever having free end 86 extending under orifice 80 and fixed end 88 that is held in retention block 90. Media 12 flowing through the control 6 as shown in FIG. 1 defines a flow path 92. The flow path 92 leaving orifice 80 strikes the beam 84 and bends it in proportion to the flow rate of media contained within the flow path 92. A high flow rate of media 12 would bend the beam 84 more than a low flow rate. The beam 84 is a flat piece of resilient material such as thin metal that in the absence of media 12 will return to a predetermined location and in response to a particular flow rate be bent a predetermined distance downward. Beneath the beam 84 is a proximity sensor 96 that returns an electrical signal proportional to the distance between the sensor 96 and the beam 84. The proximity sensor is fixed to the housing 8. Because the proximity sensor 96 detects the distance between itself and the beam 84, it measures the deflection of the beam 84, thereby the proximity sensor 96 is used to indirectly measure the flow rate in the flow path 92. The media 12 after striking the beam 84 then leaves the housing 8 via outlet 16. The beam 84 may be periodically changed by removing the retention block 90 and installing a new beam 84. This may be necessary over a long time of use depending on the abrasiveness of the media 12.

Figure 8:
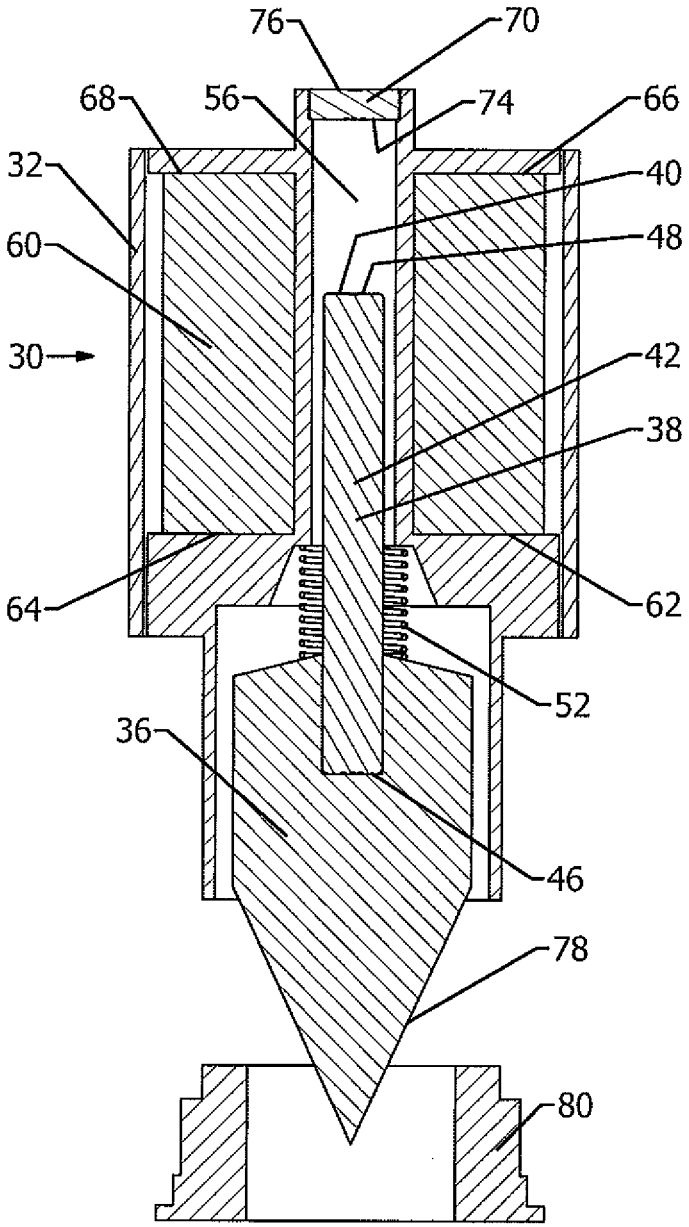
FIG. 8 is a sectional view like that shown in FIG. 7 with the spindle in its open position.

It is desirable to have control over the flow rate in the flow path 92 and this is achieved using the proximity sensor 96 in combination with the valve 30. A predetermined rate that would be a good flow rate to have in the flow path 92 is decided upon, and the control 6 is calibrated to achieve that rate. A known quantity of media 12 may be dispensed through the control 6 over a prescribed amount of time and this will yield a rate at which media 12 is being dispensed. This rate will bend the beam 84 a certain amount and a sensor 96 reading may be taken and known to correspond with that rate. The signal from the proximity sensor 96 is used as an input to a controller circuit board 102 that will send a predetermined amount of electricity to the coil 60. When the coil 60 has electricity passed through it, the first pole 64 will be energized and the second pole 68 will also be energized. As mentioned above, the first pole 64 is south and the second pole 68 is north. With the poles 64, 68 being energized, the first permanent magnet 42 will be caused to move upward within the coil 60. As this happens, the spindle 36 moves upwardly and opens up the orifice 80, which corresponds to an open position of the spindle 36 as shown in FIG. 8. When there is no current passing through the coil 60, the spindle is in its closed position shown in FIG. 7. As the spindle 36 is moved farther from the orifice 80, more media 12 will be allowed to flow through the orifice 80. The further the conical surface 78 of the spindle 36 is from the orifice 80, the higher the flow rate in the flow path 92 will be. As such the beam 84 will produce a proportional signal in the proximity sensor 96. This signal will be fed into the controller board 102 which will move the spindle up or down to adjust the flow rate to the desired flow rate. As the spindle 36 moves upward, or more open, to affect a higher flow rate, the spring 52 exerts a larger force. To assist in movement upward of the spindle 36 the first permanent magnet 42 has its second pole 48 being opposite as the first pole 74 on the second magnet 70. In other words, the opposite poles of the first and second magnets 42, 70 face each other. Thus, an attractive force is generated between the first and second 42, 70 permanent magnets that helps overcome the force of the spring 52. This will result in less energy needed in the coil 60 to move the spindle 36 upward. Typically, the electricity passing through the coil 60 is done in pulses that keep the spindle 36 at a particular location. Using different values in the algorithm controlling the flow rate, an operator can change the flow rate.

Upon leaving the outlet 16, the media 12 will be mixed with air from the air supply 18 and discharged through the nozzle 24. The media 12 leaving the control 6 will be at a precisely measured flow rate. With the air from the air supply 18 set at a desired rate, the mixing ratio of air to media may be precisely determined to affect predictable peening.

The present invention is not limited to the details given above, but may be modified within the scope of the following claims.

What is claimed is:

1. A shot peening flow control adapted for use with a non-magnetic media, said control having:

an inlet adapted to receive said media;

a valve chamber in fluid communication with said inlet, said valve chamber having a valve body affixed thereto with a central axis, a first permanent magnet located within said valve chamber having an upper distal end and a lower distal end, said valve body having a second permanent magnet affixed thereto and overlaying said first permanent magnet, said first permanent magnet moveable along said central axis between an extended position and a retracted position, said extended position defined by said upper distal end at a first distance from said second permanent magnet, said retracted position defined by said upper distal end at a second distance from said second permanent magnet, said first distance being greater than said second distance, said valve body having a coil circumscribing said upper distal end;

a spindle affixed to said lower distal end, said spindle having a tapered portion;

an orifice adapted to receive said tapered portion of said spindle;

when said valve chamber contains said media, said media circumscribes a portion of said spindle and said valve body; and when said first permanent magnet is in said extended position, said spindle is in biased contact with said orifice, when said first permanent magnet is in said retracted position, a flow path is created for said media from said inlet through said orifice.

2. The control of claim 1, wherein said valve body includes a spring urging said spindle toward a closed position against said orifice, when electricity passes through said coil, said first magnet and said spindle are pulled away from said orifice.

3. The control of claim 1, said first magnet returning to said extended position when said electricity is removed from said coil.

4. The control of claim 3, said spindle, said orifice, said coil, said first and second magnet being coaxial.

5. The control of claim 1, said orifice circumscribing a portion of said tapered portion of said spindle.

6. The control of claim 5, said tapered portion terminating at a point, when said spindle is in said closed position, said point extends through said aperture.

7. The control of claim 1, opposite poles of said first and second magnets placed so that opposite poles face each other, attraction of said opposite poles on said first and second permanent magnets providing a force urging said spindle away from said orifice.

8. The control of claim 7, said coil having a hollow center a first pole at a first end of said coil and a second pole at an opposite second end of said coil when electricity is passed through said coil, said first permanent magnet extending inwardly into said center of said coil and said upper distal end being nearer said first end of said coil when said spindle contacts said orifice, said second permanent magnet being fixed adjacent to said second end of said coil, said second pole of said coil being a like pole to said pole of said second permanent magnet that faces said first permanent magnet.

9. The control of claim 1, said orifice overlaying a distal end of a bendable member, said bendable member having a fixed end oppositely located to said distal end, said bendable member moveable between a rest position and a deflected position.

10. The control of claim 9, said control including a sensor adapted to sense said bendable member and in electrical communication with said valve body, a portion of said bendable member overlaying said sensor, said rest position defined by a relatively far distance between said bendable member and said sensor, said deflected position defined by a relatively close distance between said bendable member and said sensor, said distal end overlaying an outlet.

11. The control of claim 10, when said bendable member is a relatively far distance from said sensor, said first magnet is moved from said extended position toward said refracted position.

12. The control of claim 1, when said valve chamber is full of said media, a portion of said media overlays said valve body.

13. A control for regulating the flow of a non-ferrous media comprising:

a valve chamber adapted to receive said media through an inlet and an orifice adapted to dispense said media through an aperture;

a spindle having a tapered portion, said spindle moveable between an open position and a closed position, said open position defined by a flow path between said inlet and said orifice, said closed position defined by said tapered portion contacting said aperture;

a valve body affixed to said valve chamber and having a coil circumscribing an upper terminal end of a first permanent magnet, said valve body having a second permanent magnet overlaying said upper terminal end, a lower terminal end of said first permanent magnet affixed to said spindle, said first permanent magnet axially moveable between a retracted position and an extended position, said extended position defined by said upper terminal end at a first distance from said second permanent magnet, said refracted position defined by said upper terminal end at a second distance from said second permanent magnet, said first distance being greater than said second distance;

said media partially surrounding said valve body and said spindle when said valve chamber is filled with said media; and when electric current is applied to said coil, said first magnet moves toward said second magnet and said spindle moves from said closed position toward said open position, when said electric current is removed from said coil, said spindle returns to said closed position.

14. The control of claim 13, a spring circumscribing a portion of said first magnet, said spring urging said spindle into biased contact with said aperture.

15. The control of claim 14, said media circumscribing a portion of said spindle when said valve chamber contains said media.

16. The control of claim 15, said tapered portion terminating at a point, when said spindle is in said closed position, said point extends through said aperture.

17. The control of claim 15, said orifice overlaying a distal end of a bendable member, said bendable member having a fixed end oppositely located to said distal end, said bendable member moveable between a rest position and a deflected position.

18. The control of claim 17, said control including a sensor adapted to sense said bendable member and in electrical communication with said valve body, a portion of said bendable member overlaying said sensor, said rest position defined by a relatively far distance between said bendable member and said sensor, said deflected position defined by a relatively close distance between said bendable member and said sensor, said distal end overlaying an outlet.

19. The control of claim 18, when said bendable member is a relatively far distance from said sensor, said spindle is moved from said closed position to said open position.

20. The control of claim 13, when said valve chamber is full of said media, said media surrounds said valve body.

* * * * *